US011313110B1

(12) United States Patent
Wu et al.

(10) Patent No.: US 11,313,110 B1
(45) Date of Patent: Apr. 26, 2022

(54) WATER OUTPUT DEVICE

(71) Applicant: Purity (Xiamen) Sanitary Ware Co., Ltd., Xiamen (CN)

(72) Inventors: James Wu, Taichung (TW); Alex Wu, Taichung (TW); Ce-Wen Yang, Xiamen (CN); Ching-Yin Wu, Taichung (TW); Che-Min Lin, Taichung (TW)

(73) Assignee: PURITY (XIAMEN) SANITARY WARE CO., LTD., Xiamen (CN)

( * ) Notice: Subject to any disclaimer, the term of this patent is extended or adjusted under 35 U.S.C. 154(b) by 0 days.

(21) Appl. No.: 17/124,993

(22) Filed: Dec. 17, 2020

(30) Foreign Application Priority Data

Oct. 9, 2020 (CN) ..... 202022234349.5

(51) Int. Cl.
*E03C 1/04* (2006.01)
*A47K 3/28* (2006.01)
*E03C 1/042* (2006.01)

(52) U.S. Cl.
CPC ..... *E03C 1/0408* (2013.01); *A47K 3/281* (2013.01); *E03C 1/042* (2013.01)

(58) Field of Classification Search
CPC ..... E03C 1/0408; E03C 1/042; A47K 3/281
USPC ..... 4/675–678
See application file for complete search history.

(56) References Cited

U.S. PATENT DOCUMENTS 6,550,079 B2 * 4/2003 Gransow ..... E03C 1/066 4/615
2020/0181894 A1 * 6/2020 Chung ..... E03C 1/0408
2020/0354231 A1 * 11/2020 Ota ..... C02F 1/003
2022/0025621 A1 * 1/2022 Backus ..... E03C 1/0465

FOREIGN PATENT DOCUMENTS

DE 10 2004 048 900 A1 4/2006
EP 1 757 740 A1 2/2007
EP 1 359 250 B1 10/2007

OTHER PUBLICATIONS

Extended European Search Report for European Application No. 21191454.4, dated Jan. 27, 2022.

* cited by examiner

*Primary Examiner* — Christine J Skubinna
(74) *Attorney, Agent, or Firm* — Birch, Stewart, Kolasch & Birch, LLP

(57) ABSTRACT

A water output device is adapted to be connected to an inlet tube and includes an outlet tube and an outlet shelf having an upper outlet surface. The outlet tube passes through the outlet shelf and extends upward from the upper outlet surface and communicates with the inlet tube. A side wall of the outlet tube has a first outlet opening. The upper outlet surface has a guiding recess having an open side formed on a side edge of the upper outlet surface, so that a water flowing from the first outlet opening is guided by the guiding recess to flow out through the open side. The outlet shelf could be placed bath supplies and provide users with a special visual experience, and water could be outputted from the first outlet opening beyond the outlet shelf and guided by the guiding recess to flow out through the open side.

10 Claims, 12 Drawing Sheets

WATER OUTPUT DEVICE

BACKGROUND OF THE INVENTION

Technical Field

The present invention relates generally to a bathroom accessory, and more particularly to a water output device that supplies water via a shelf.

Description of Related Art

A conventional faucet is a kind of bathroom accessories and is widely used in various places. In a normal family, the faucet is mainly mounted in a kitchen and a bathroom for cleaning kitchen supplies and taking a shower. For the convenience of a user to obtain detergents, cleaning tools, or bath supplies during showering and cleaning, a shelf is often disposed around the faucet for placing supplies such as the cleanser, the cleaning tools, the bath supplies, and so on. In order to improve the convenience for users to take objects placed on the shelf, some manufacturers in the industry have developed a platform-type faucet.

The conventional platform-type faucet includes a platform engaged with a faucet. However, the platform only has the function for users to place toilet products such as hand wash, shampoo, body wash, or soap, and does not have other functions. In addition, conventional faucets are always output water via a water outlet under the faucet, and cannot provide the user with a special visual experience. Thus, the conventional platform-type faucet still has room for improvement.

BRIEF SUMMARY OF THE INVENTION

In view of the above, the primary objective of the present invention is to provide a water output device, which could supply water via a shelf.

The present invention provides a water output device, which is adapted to be connected to an inlet tube, includes an outlet shelf and an outlet tube, wherein the outlet shelf has an upper outlet surface. The outlet tube passes through the outlet shelf and extends upward from the upper outlet surface and communicates with the inlet tube. A side wall of the outlet tube has a first outlet opening. The upper outlet surface has a guiding recess. The guiding recess has an open side formed on a side edge of the upper outlet surface, so that a water flowing from the first outlet opening is guided by the guiding recess to flow out through the open side.

In an embodiment, a recessed surface of the guiding recess tilts in a direction from the first outlet opening toward the open side.

In an embodiment, the open side of the guiding recess is curved-shaped.

In an embodiment, the recessed surface of the guiding recess has a plurality of projecting patterns sequentially arranged in a direction from the outlet tube toward the open side.

In an embodiment, the water output device includes a filter disposed on the outlet tube and located at the first outlet opening.

In an embodiment, the outlet shelf has a sleeve; an end of the sleeve is connected to the upper outlet surface, and another end of the sleeve extends upward from the upper outlet surface; the sleeve has a side opening; the outlet tube is disposed in the sleeve, and the first outlet opening corresponds to the side opening.

In an embodiment, a slot is disposed on a peripheral edge of the side opening of the sleeve, and the filter is detachably disposed in the slot and covers the first outlet opening.

In an embodiment, the outlet shelf comprises a top cover and a bottom base; the top cover covers the bottom base and has the upper outlet surface and the sleeve. The outlet tube is disposed on the bottom base and enters the sleeve via an underside of the sleeve.

In an embodiment, the water output device includes a switching valve disposed in the outlet tube, wherein the outlet tube has a second outlet opening. The switching valve is controllable to switch water from flowing out through the first outlet opening or the second outlet opening.

In an embodiment, the water output device includes a pressed member connected to the switching valve and located above the outlet tube, wherein the pressed member is adapted to be pressed by an external force to control the switching valve to switch.

With the aforementioned design, water could be outputted from the first outlet opening beyond the outlet shelf and be guided by the guiding recess to flow out through the open side of the outlet shelf, which provides users with a special visual experience at the same time.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
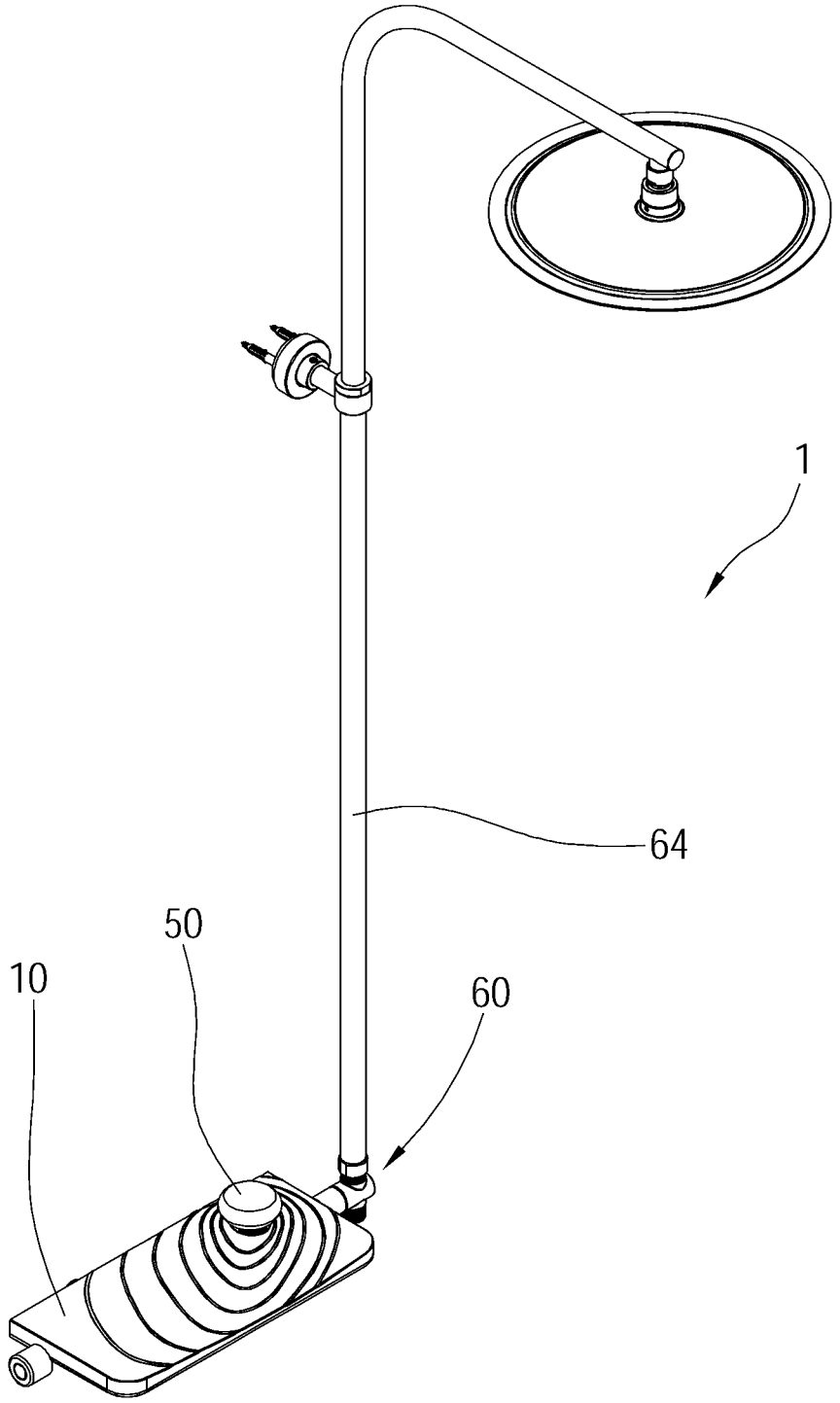
FIG. 1 is a perspective view of the water output device according to an embodiment of the present invention.
Figure 2:
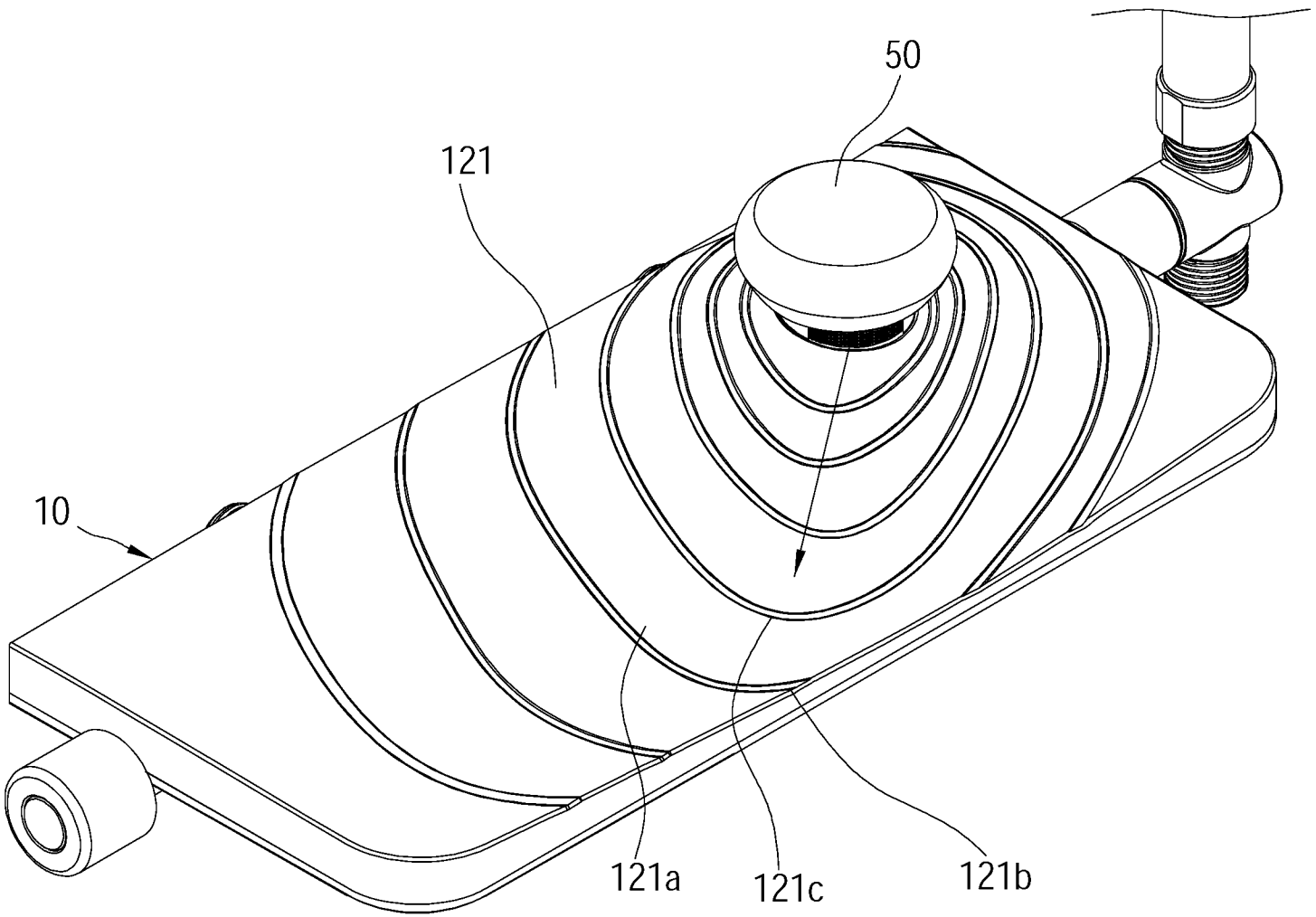
FIG. 2 is a perspective view, showing the water output device according to the embodiment of the present invention.
Figure 3:
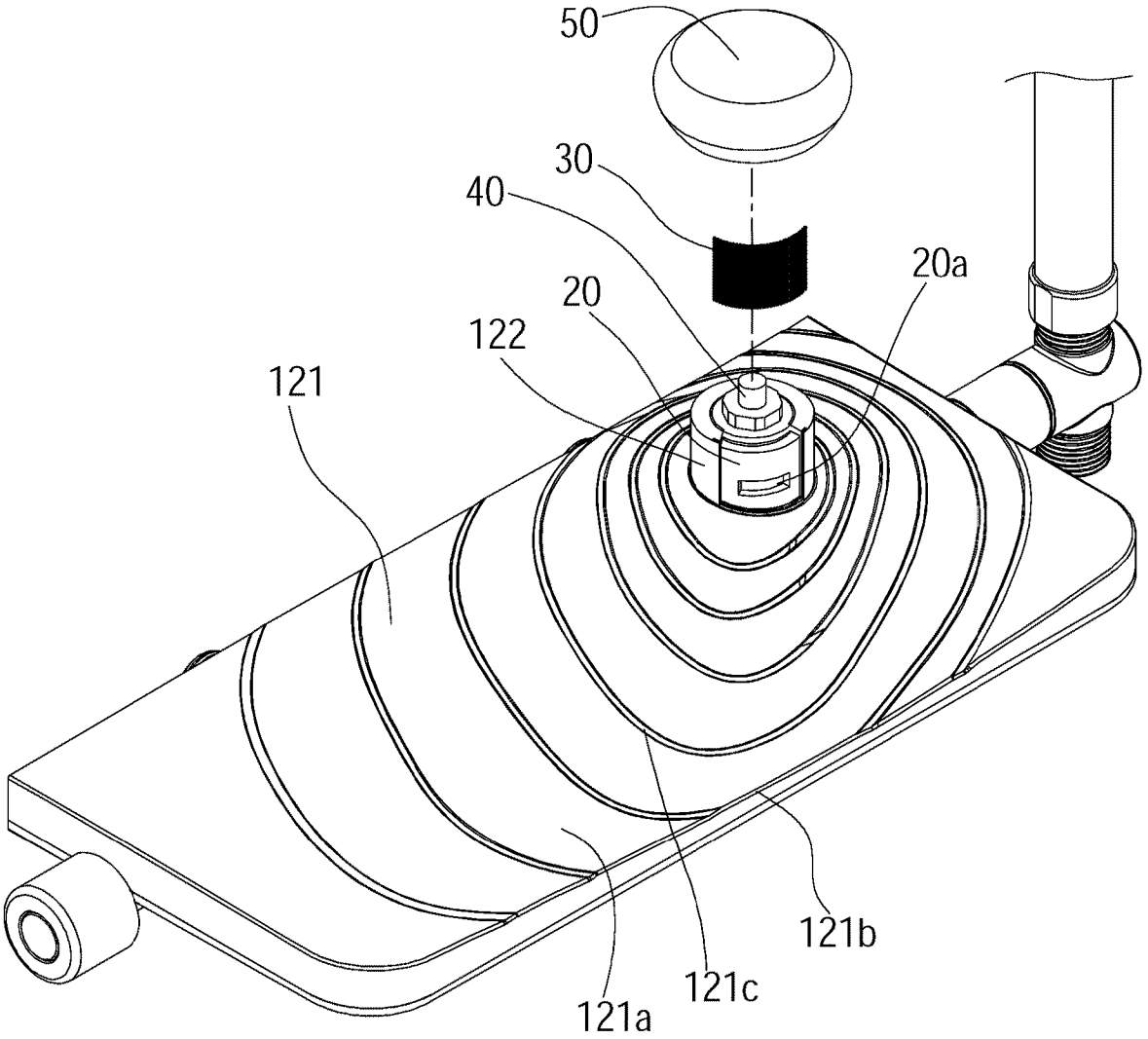
FIG. 3 is a partially exploded view of the water output device according to the embodiment of the present invention.

A water output device 1 according to an embodiment of the present invention is illustrated in FIG. 1 to FIG. 12, wherein the water output device 1 includes an inlet tube 2.

The inlet tube 2 includes a cold-water pipe 2A and a hot-water pipe 2B. The water output device 1 includes an outlet shelf 10, an outlet tube 20, a filter 30, a switching valve 40, and a pressed member 50.

Referring to FIG. 1 to FIG. 6, the outlet shelf 10 includes a top cover 12 and a bottom base 14, wherein the top cover 12 covers the bottom base 14 and has an upper outlet surface 121 and a sleeve 122. The upper outlet surface 121 has a guiding recess 121*a*, wherein the guiding recess 121*a* has an open side 121*b* formed on a side edge of the upper outlet surface 121. An end of the sleeve 122 is connected to the upper outlet surface 121, and another end of the sleeve 122 extends upward from the upper outlet surface 121, wherein upward indicates a direction from the bottom base 14 toward the top cover 12. The sleeve 122 has a side opening 122*a*, wherein a slot 122*b* is disposed on a peripheral edge of the side opening 122*a* of the sleeve 122, and the filter 30 is detachably disposed in the slot 122*b*.

The outlet tube 20 is disposed on the bottom base 14 of the outlet shelf 10 and communicates with the inlet tube 2. The outlet tube 20 enters the sleeve 122 via an underside of the sleeve 122 of the outlet shelf 10 to be disposed in the sleeve 122 and extends upward and beyond the upper outlet surface 121. A side wall of the outlet tube 20 has a first outlet opening 20*a* corresponding to the side opening 122*a* of the sleeve 122, wherein the filter 30 is disposed at a position covering the first outlet opening 20*a*. In an embodiment, the filter 30 is disposed on the outlet tube 20 and is located at a position covering the first outlet opening 20*a*. In this way, water could be outputted via the first outlet opening 20*a* located beyond the outlet shelf 10 and could be guided by the guiding recess 121*a* to flow out through the open side 121*b* of the outlet shelf 10, so that the outlet shelf 10 not only could provide users with a special visual experience, but also could be used for placing bath supplies. Additionally, with the filter 30, not only a foreign matter in the water could be filtered, but also a flow rate of the water outputted from the first outlet opening 20*a* could be slowed down, so as to slow down an impact of the water flow against the upper outlet surface 121. In the current embodiment, the filter 30 is detachably disposed in the slot 122*b*, however, in other embodiments, the filter 30 could be disposed in other ways as long as the filter is located at a position covering the first outlet opening 20*a*. For instance, the filter 30 could fit around the outlet tube 20 to cover the first outlet opening 20*a*.

Referring to FIG. 7 to FIG. 11, a recessed surface of the guiding recess 121*a* tilts from a position adjacent to the first outlet opening 20*a* to the open side 121*b*, wherein the open side 121*b* of the guiding recess 121*a* is a curved shape curving in a direction from the upper outlet surface 121 toward the bottom base 14. In this way, the water outputted from the first outlet opening 20*a* could be guided by the guiding recess 121*a* to flow and gather to the open side 121*b* which is curved-shaped. In addition, the recessed surface of the guiding recess 121*a* has a plurality of projecting patterns 121*c*, wherein the projecting patterns 121*c* are disposed in a way surrounding the outlet tube 20 and are sequentially arranged in a direction from the outlet tube 20 toward the open side 121*b*, and provides a function of slowing down the flow rate of the water flowing on the upper outlet surface 121 and guiding the water to the open side 121*b*.

Figure 4:
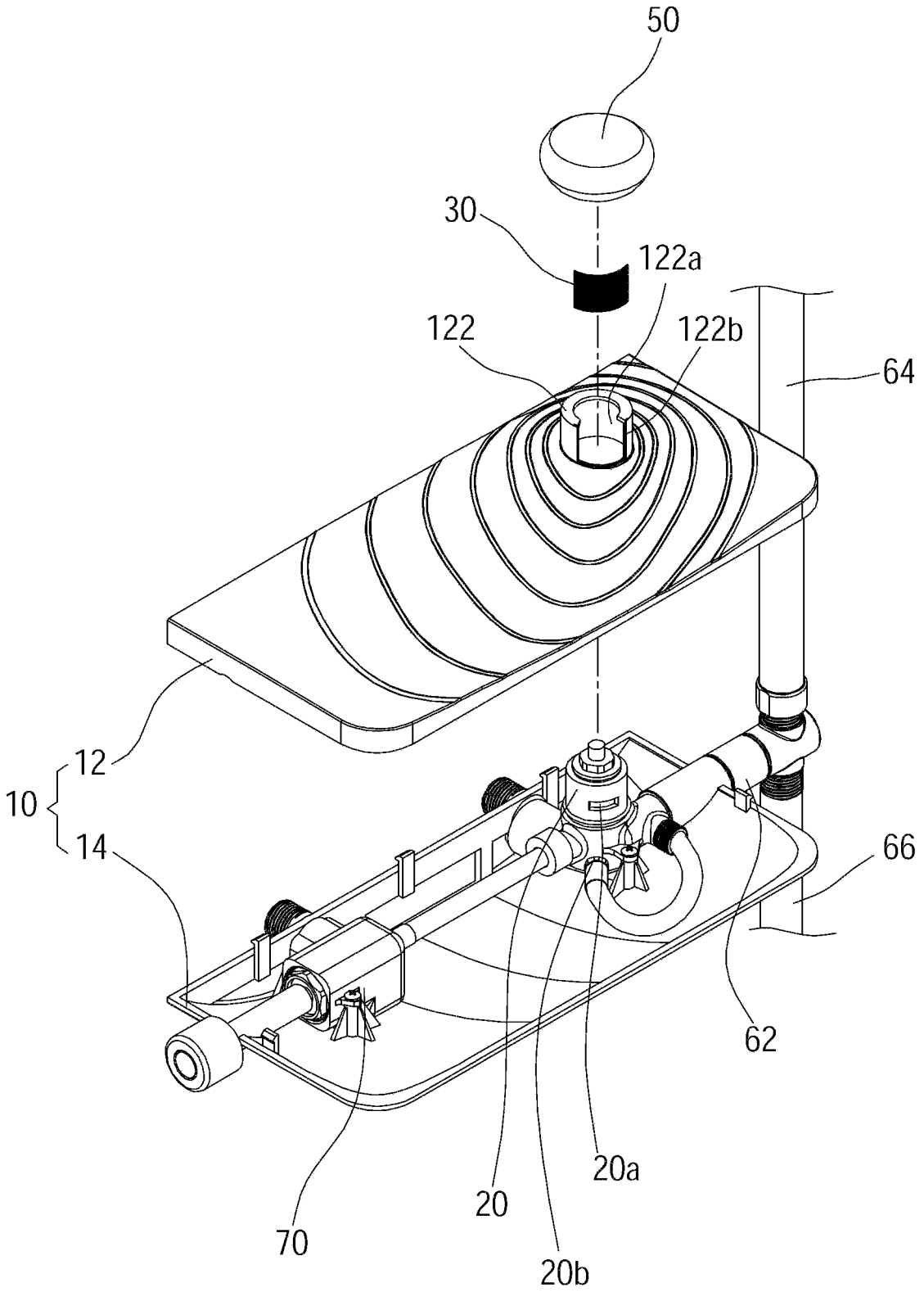
FIG. 4 is a partially exploded view of the water output device according to the embodiment of the present invention.
Figure 5:
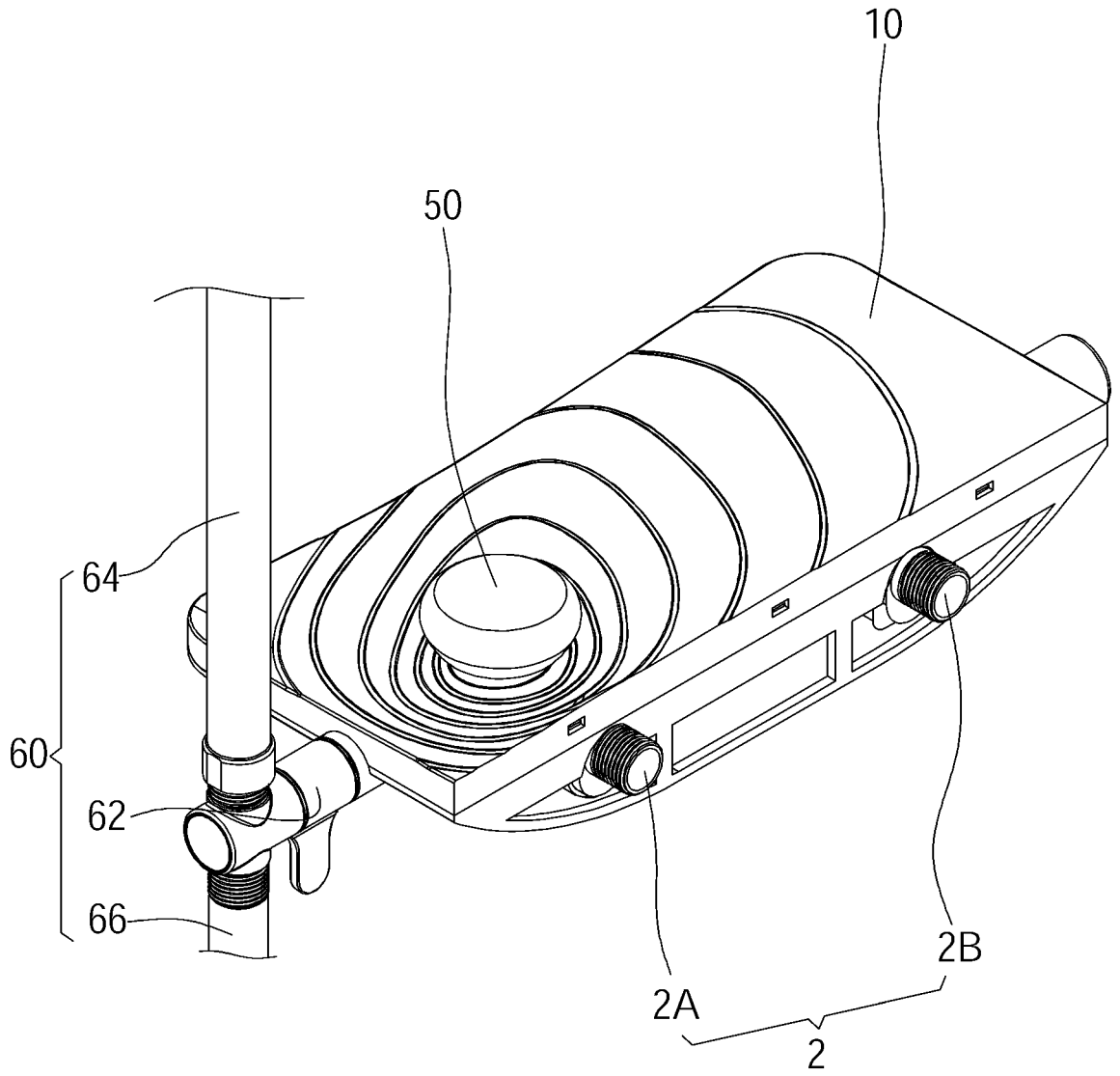
FIG. 5 is a perspective view, showing the water output device according to the embodiment of the present invention seen from another direction.
Figure 6:
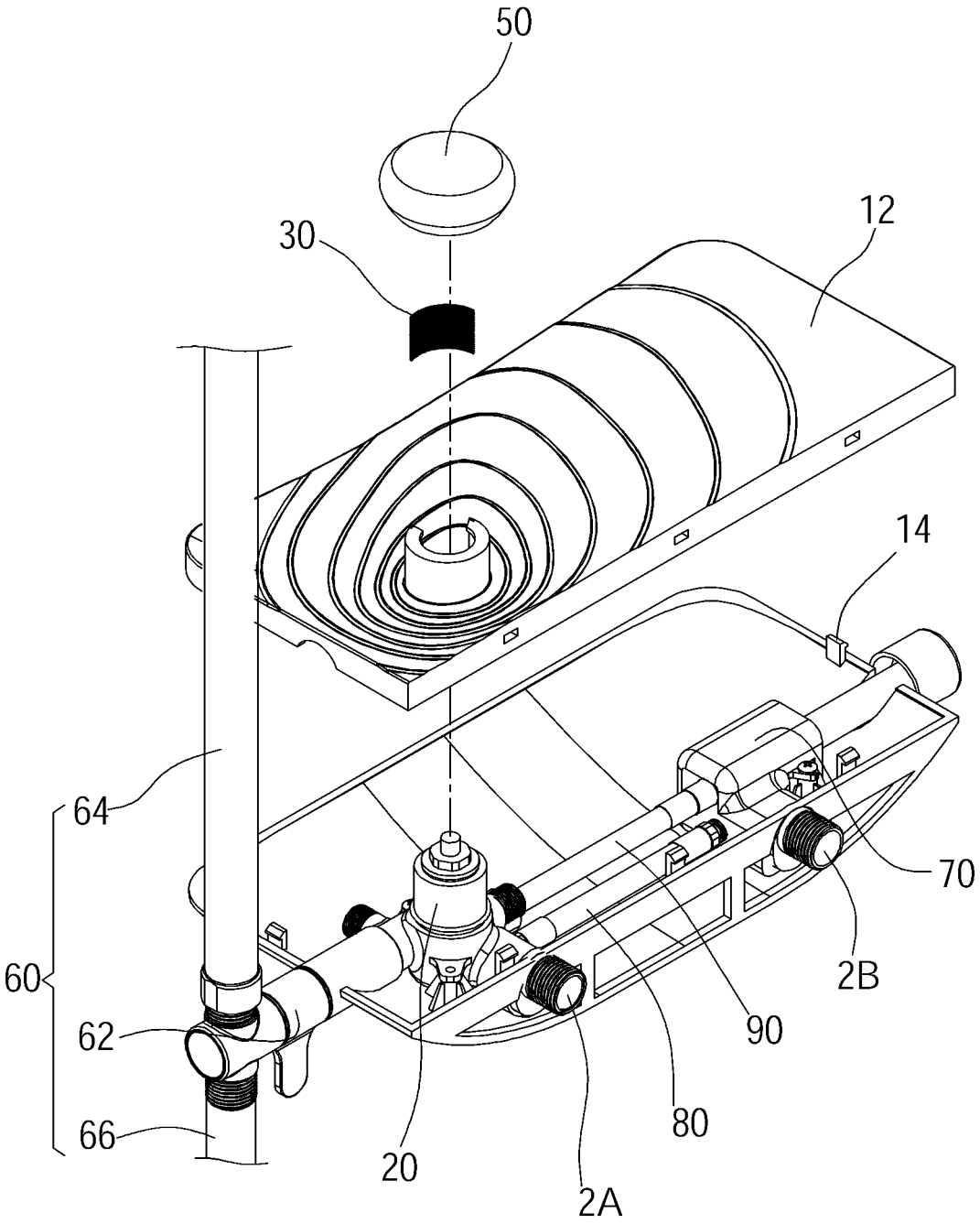
FIG. 6 is a partially exploded view of the water output device according to the embodiment of the present invention.
Figure 7:
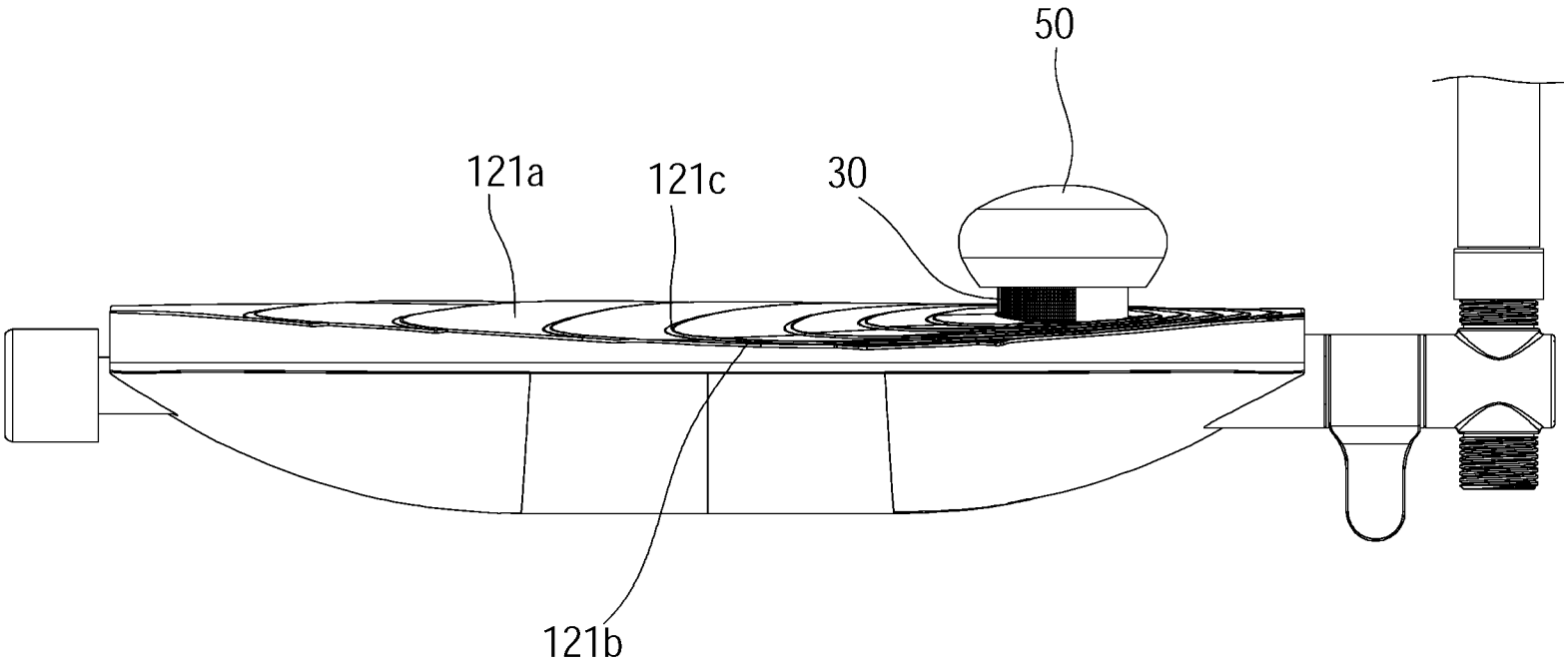
FIG. 7 is a side view, showing the water output device according to the embodiment of the present invention.
Figure 8:
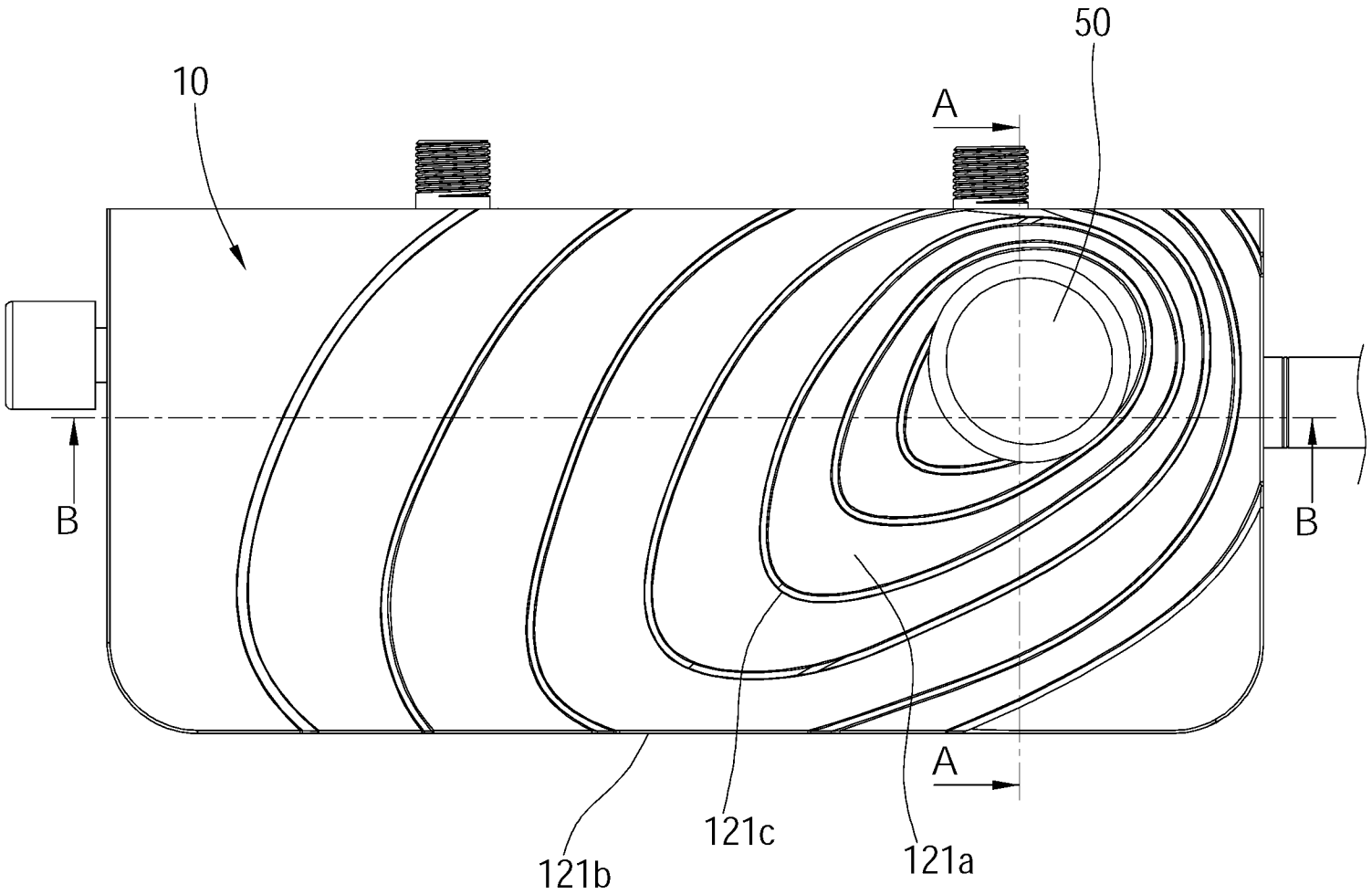
FIG. 8 is a top view, showing the water output device according to the embodiment of the present invention.
Figure 9:
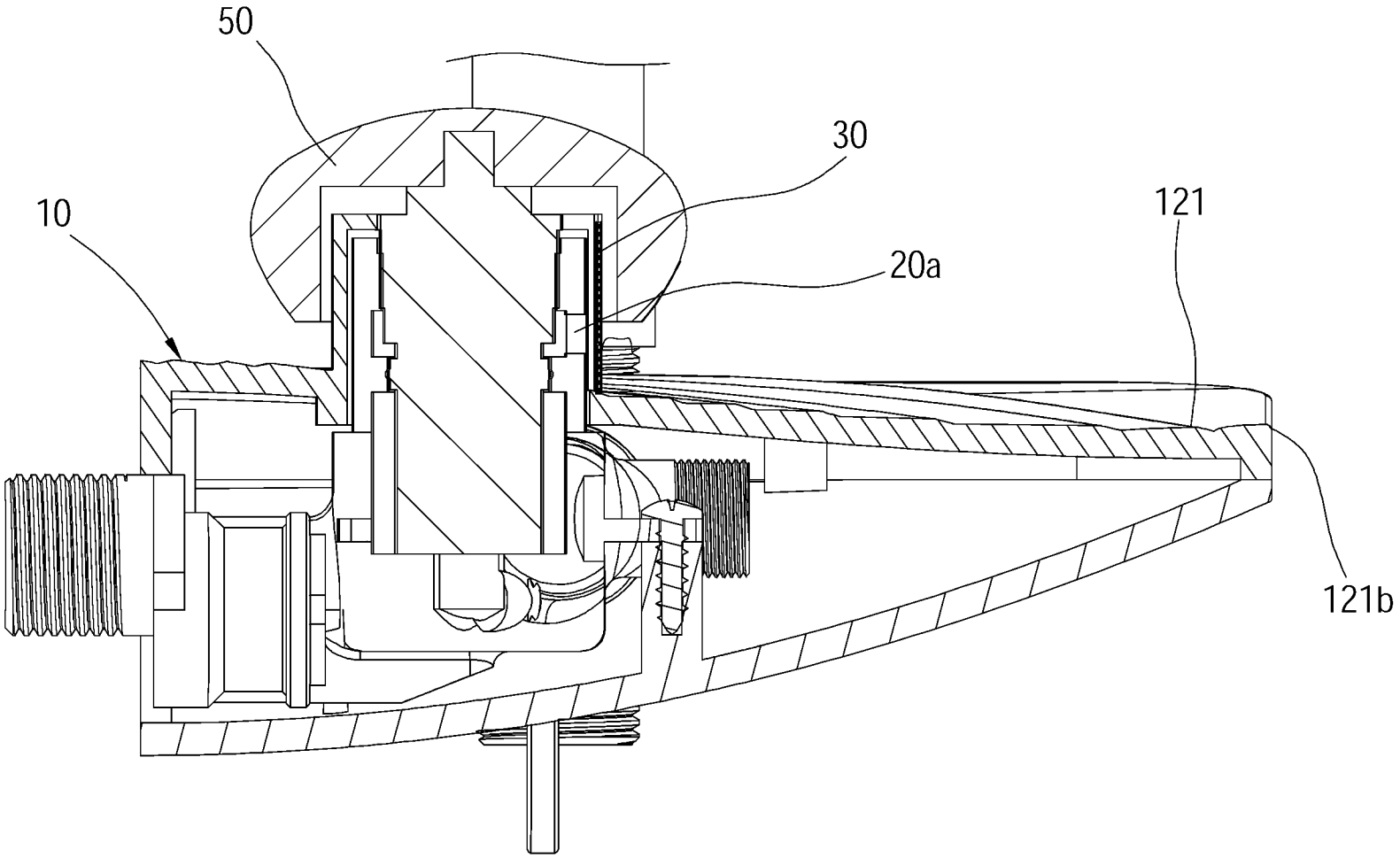
FIG. 9 is a sectional view along the A-A line in FIG. 8.
Figure 10:
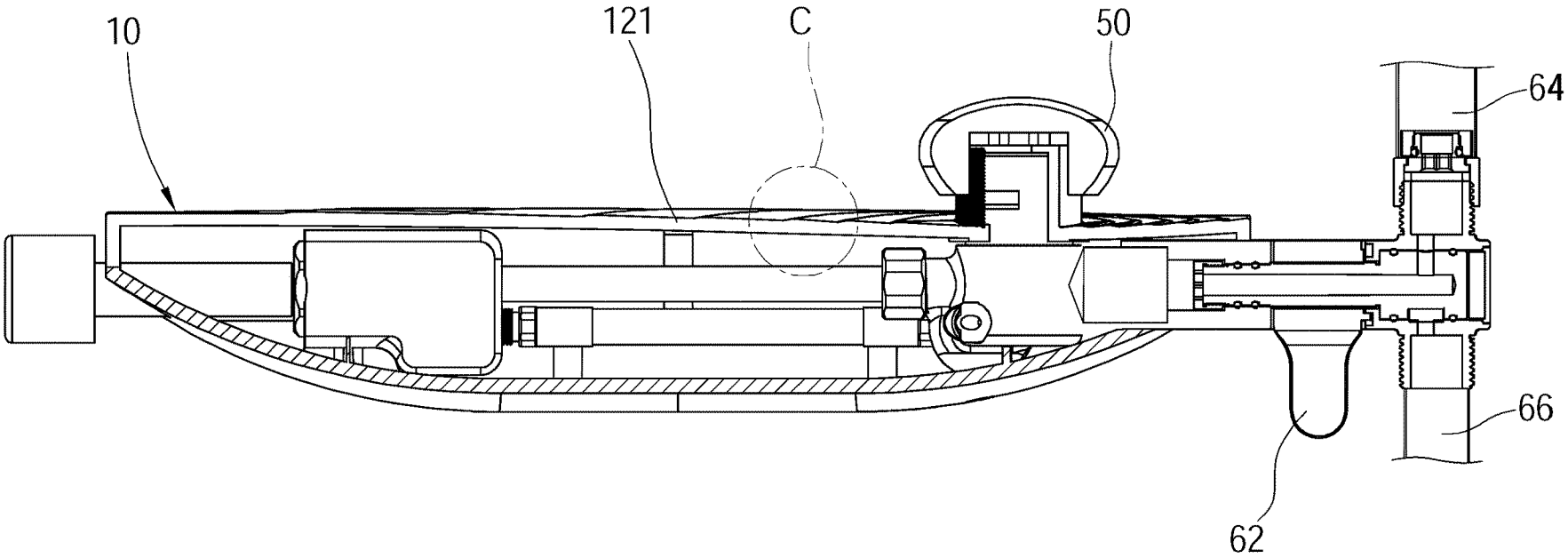
FIG. 10 is a sectional view along the B-B line in FIG. 8.
Figure 11:
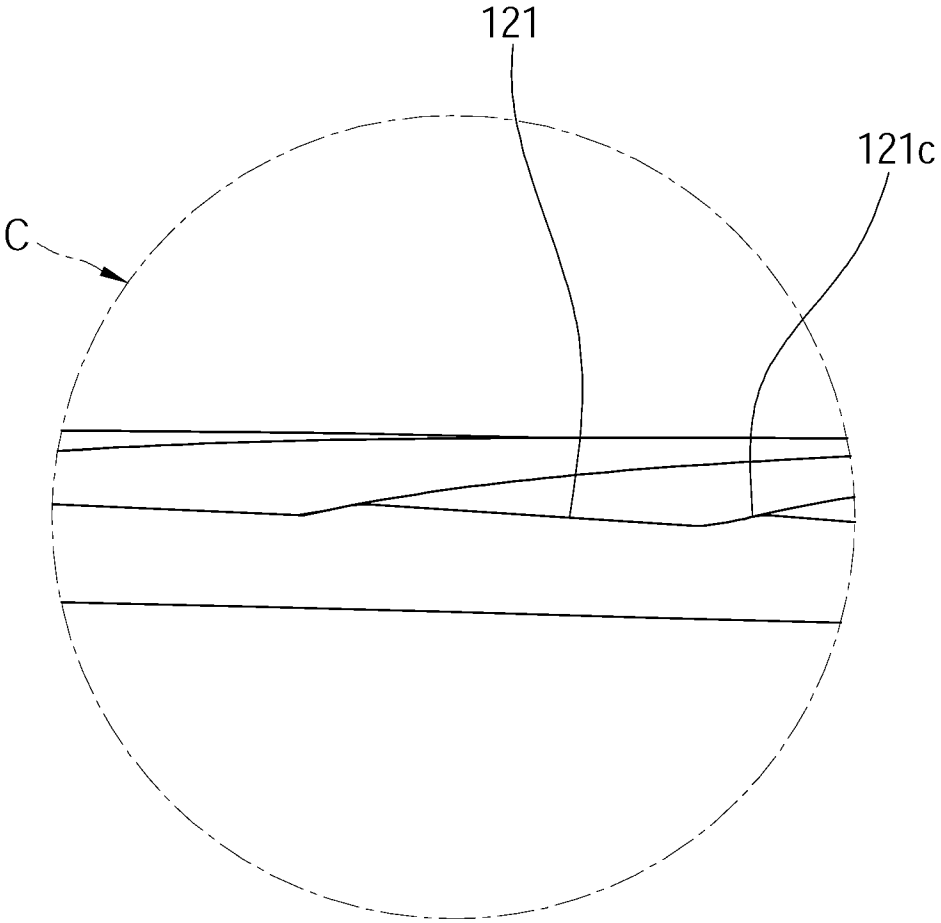
FIG. 11 is an enlarged partial view of a marked region C in FIG. 10.

Referring to FIG. 4, the switching valve 40 is disposed in the outlet tube 20, wherein the outlet tube 20 has a second outlet opening 20*b*. The switching valve 40 is controllable to switch between the first outlet opening 20*a* and the second outlet opening 20*b*, so that water could flow out from either the first outlet opening 20*a* or the second outlet opening 20*b*. The pressed member 50 is connected to the switching valve 40 and is located above the outlet tube 20, and is adapted to be pressed by an external force to control the switching valve 40 to switch. Referring to FIG. 6, the water output device 1 includes a water output member 60 communicating with the second outlet opening 20*b*, wherein the water output member 60 includes a switching member 62, a shower bar 64, and a water output hose 66. The switching member 62 is disposed between the second outlet opening 20*b* and both of the shower bar 64 and the water output hose 66, thereby the switching member 62 could be controlled to switch between shower bar 64 and the water output hose 66, so that water could flow out from either the shower bar 64 or the water output hose 66. In this way, a user could operate the pressed member 50 to control the switching valve 40 to switch water from flowing out through the first outlet opening 20*a* or the second outlet opening 20*b* and could operate the switching member 62 to switch water from flowing out through the shower bar 64 or the water output hose 66, thereby providing various water outlet ways to meet specific requirements.

Figure 12:
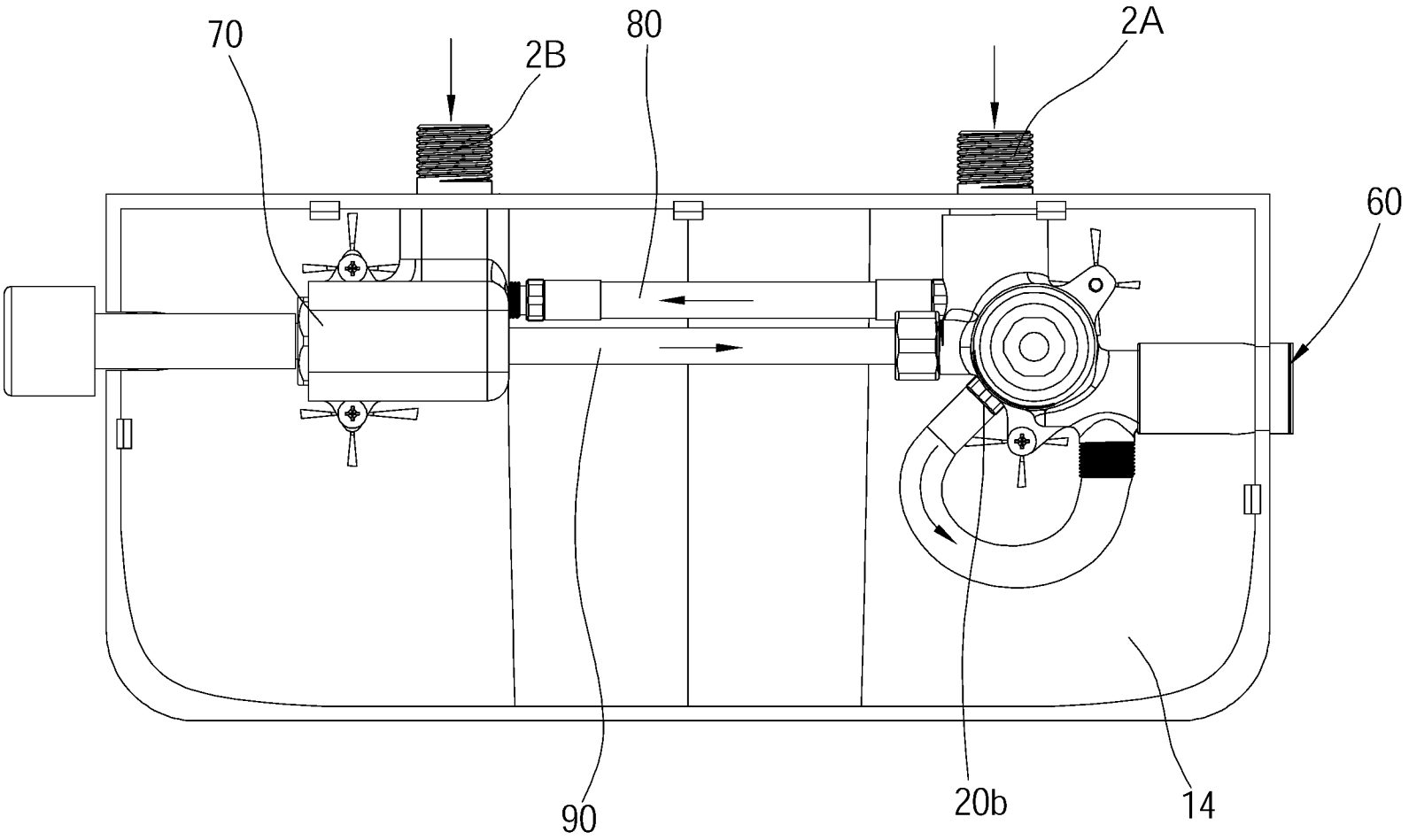
FIG. 12 is a schematic view, showing the control valve, the first connecting tube, and the second connecting tube of the water output device according to the embodiment of the present invention.

Referring to FIG. 12, the water output device 1 includes a control valve 70, a first connecting pipe 80, and a second connecting pipe 90, wherein the first connecting pipe 80 communicates with both of the cold-water pipe 2A and the control valve 70, and the hot-water pipe 2B communicates with the control valve 70, and the control valve 70 communicates with the switching valve 40 via the second connecting pipe 90, so that the control valve 70 could be controlled to adjust a mixing ratio of hot and cold water. In this way, the cold water come from the cold-water pipe 2A could flow into the control valve 70 via the first connecting pipe 80 and mix with the hot water, which comes from the hot-water pipe 2B, in the control valve 70, and then the mixed water could be guided into the outlet tube 20 via the second connecting pipe 90, and finally, the mixed water could be outputted from either the first outlet opening 20*a* or the second outlet opening 20*b* by operating the pressed member 50 to control the switching valve 40 to switch between the first outlet opening 20*a* and the second outlet opening 20*b*.

With the aforementioned design, water could be outputted from the first outlet opening 20*a* above the outlet shelf 10 of the water output device 1 and could be guided by the guiding recess 121*a* to flow out through the open side 121*b* of the outlet shelf 10, which not only could provide users with a special visual experience, but also could be used for placing bath supplies. Additionally, the water output device 1 further provides various water outlet ways to meet specific requirements.

It must be pointed out that the embodiments described above are only some preferred embodiments of the present invention. All equivalent structures which employ the concepts disclosed in this specification and the appended claims should fall within the scope of the present invention.

What is claimed is:

1. A water output device, which is adapted to be connected to an inlet tube, comprises an outlet shelf and an outlet tube, wherein the outlet shelf has an upper outlet surface; the outlet tube passes through the outlet shelf and extends upward from the upper outlet surface and communicates with the inlet tube; a side wall of the outlet tube has a first outlet opening; the upper outlet surface has a guiding recess; the guiding recess has an open side formed on a side edge of the upper outlet surface, so that a water flowing from the first outlet opening is guided by the guiding recess to flow out through the open side.

2. The water output device as claimed in claim 1, wherein a recessed surface of the guiding recess tilts in a direction from the first outlet opening toward the open side.

3. The water output device as claimed in claim 2, wherein the open side of the guiding recess is curved-shaped.

4. The water output device as claimed in claim 3, wherein the recessed surface of the guiding recess has a plurality of projecting patterns sequentially arranged in a direction from the outlet tube toward the open side.

5. The water output device as claimed in claim 1, further comprising a filter disposed on the outlet tube and located at the first outlet opening.

6. The water output device as claimed in claim 1, wherein the outlet shelf has a sleeve; an end of the sleeve is connected to the upper outlet surface, and another end of the sleeve extends upward from the upper outlet surface; the sleeve has a side opening; the outlet tube is disposed in the sleeve, and the first outlet opening corresponds to the side opening.

7. The water output device as claimed in claim 6, further comprising a filter, wherein a slot is disposed on a peripheral edge of the side opening of the sleeve, and the filter is detachably disposed in the slot and covers the first outlet opening.

8. The water output device as claimed in claim 6, wherein the outlet shelf comprises a top cover and a bottom base; the top cover covers the bottom base and has the upper outlet surface and the sleeve; the outlet tube is disposed on the bottom base and enters the sleeve via an underside of the sleeve.

9. The water output device as claimed in claim 1, further comprising a switching valve disposed in the outlet tube, wherein the outlet tube has a second outlet opening; the switching valve is controllable to switch water from flowing out through the first outlet opening or the second outlet opening.

10. The water output device as claimed in claim 9, further comprising a pressed member connected to the switching valve and located above the outlet tube, wherein the pressed member is adapted to be pressed by an external force to control the switching valve to switch.

* * * * *